US005755251A

United States Patent [19]

Simonette

[11] Patent Number: 5,755,251

[45] Date of Patent: May 26, 1998

[54] FULL FLOW PRESSURE TRAP UNLOADER VALVE

[75] Inventor: Dallas W. Simonette, Andover, Minn.

[73] Assignee: GP Companies, Inc., Mendota Heights, Minn.

[21] Appl. No.: 566,568

[22] Filed: Nov. 28, 1995

[51] Int. Cl.[6] ..... G05D 7/01; F16K 11/18

[52] U.S. Cl. ..... 137/115.13; 137/115.2; 137/115.28

[58] Field of Search ..... 137/115.13, 115.18, 137/115.2, 115.28

[56] References Cited

U.S. PATENT DOCUMENTS

| | | | |
|---|---|---|---|
| 3,439,696 | 4/1969 | Valentine | 137/115.2 |
| 3,451,416 | 6/1969 | Nyberg . | |
| 3,558,244 | 1/1971 | Uchiyama . | |
| 3,652,188 | 3/1972 | Uchiyama . | |
| 3,707,981 | 1/1973 | Sadler et al. . | |
| 3,809,508 | 5/1974 | Uchiyama . | |
| 3,920,356 | 11/1975 | Bruggeman . | |
| 3,930,756 | 1/1976 | Bruggeman . | |
| 3,939,859 | 2/1976 | Ueda et al. | 137/115.13 |
| 3,953,154 | 4/1976 | Wanner . | |
| 4,057,072 | 11/1977 | Cook . | |
| 4,171,708 | 10/1979 | Pareja . | |
| 4,292,990 | 10/1981 | Pareja . | |
| 4,512,358 | 4/1985 | Kuzma . | |
| 5,035,580 | 7/1991 | Simonette . | |
| 5,163,820 | 11/1992 | Karliner . | |

*Primary Examiner*—Stephen M. Hepperle

*Attorney, Agent, or Firm*—Craig J. Lervick; Jennifer K. Farrar

[57] ABSTRACT

An unloader valve for a high pressure pumping system is disclosed. The unloader valve diverts fluid back to the pump inlet when the discharge line is blocked, and directs flow to the pump outlet when the line is unblocked. The unloader valve includes a valve body with a central cavity, a bypass check valve which also functions as a pressure relief valve, a shuttle positioned in the central cavity and a discharge check valve. A spring in the bypass check valve holds the bypass check valve closed while the system is in the spray mode. The discharge check valve closes when the line is blocked, and the line pressure is trapped between the discharge check valve and the spray gun. When the gun is reactivated, the pressure trapped behind the discharge check valve moves the shuttle forward, which opens the bypass valve.

10 Claims, 6 Drawing Sheets

FULL FLOW PRESSURE TRAP UNLOADER VALVE

BACKGROUND OF THE INVENTION

The present invention generally relates to unloader valves for use with positive displacement pumps. In particular, the present invention relates to unloader valves which are useful as a component of a positive displacement pump pressure washing system.

In high pressure pump applications, unloader valves, also referred to as "diverter valves" in the industry are either built into or are incorporated into the high pressure side of a high pressure pumping system. Unloader valves function to automatically direct water flow from the pump outlet to a gun, for example in a pressure washing system when the trigger is actuated. When the trigger gun is released, the known unloader valve automatically diverts fluid from the pump discharge back to the fluid supply or fluid inlet line. This is called "the bypass mode."Of the known unloader valves, approximately five percent of the volume of liquid pumped is bypassed through the unloader valve and routed back into the pump inlet when the pump is in the operational, or in the case of a pressure washer, the "spray" mode. Energy is expended pumping the bypassed liquid, but no actual work can be accomplished with the liquid. The efficiency of a high pressure pump system which incorporates an unloader valve with a portion of the fluid stream bypassing the liquid outlet line is lower than would be possible with an unloader valve which is capable of utilizing the entire flow from the pump outlet.

Known unloader valves cause an abrupt change in line pressure when the gun is activated. FIG. 1 is a graphical representation of the line pressure at the inlet of the unloader valve verses time of known unloader valves. At point "t", the gun is actuated, causing the system pressure to rapidly increase until the system reaches its maximum operating pressure, which typically is in the neighborhood of 1500 pounds per square inch at about 2.5 gallons per minute for a gasoline engine driven system.

The pressure change which occurs when the gun is triggered causes a jolt to the gun and often causes the gun to jump. The shock can cause an operator to lose his or her balance, and is known to cause slip and fall injuries. The abrupt pressure change, also referred to as "water hammer" causes wear on the pumping system and can lead to premature failure of high pressure components. Pump components, piping systems, spray guns, high pressure hoses, gauges, pop-off valves and hose connections are all effected.

The safety of a high pressure positive displacement pumping system requires that the high pressure side be equipped with a pressure relief device. If the pumping system is a pressure washer, an external relief device is typically installed on the discharge side of the pump. Manufacturers of positive displacement pumps always recommend the installation of a secondary pressure relief device, to be used in combination with known unloader valves.

It would be desirable to incorporate a relief valve into the pump which assures that a pressure relief valve will be part of a high pressure pump system. It would be even more desirable to provide a pressure relief system as in integral part of an unloader valve. An unloader valve that channels the full flow of fluid in the spray mode would provide greater cleaning efficiency and reduce the operational cost of a high pressure pumping system. An unloader valve with fewer parts would also reduce the cost of manufacture and increase the reliability of a high pressure pumping system.

SUMMARY OF THE INVENTION

The present invention is an unloader valve for a high pressure pumping system. The unloader valve diverts fluid back to the pump inlet when the discharge line is blocked, and directs flow to the system outlet when the line is unblocked.

The unloader valve includes a valve body with an inlet, an outlet, a bypass, each fluidly connected to a central cavity. A combination bypass and pressure relief valve, herein after referred to as a "bypass check valve" is mounted on the valve body at the bypass and opens when the discharge of the pump is blocked. The bypass check valve also functions as a pressure relief valve. A shuttle is positioned in the central cavity. A first end of the shuttle in the "bypass" mode activates the bypass check valve. A discharge check valve is provided in the outlet which is normally in an open position when the discharge line is open. When the discharge line is blocked, the discharge check valve closes.

In operation, when the discharge line in a high pressure washing system becomes blocked, the discharge check valve closes, and pressure is trapped between the discharge check valve and the spray gun. This causes a pressure differential between opposite ends of the shuttle. The shuttle then moves towards the bypass check valve, and the leading end of the shuttle opens the bypass valve.

When the gun is returned back to operation, the bypass check valve closes and moves the shuttle back to the operating position. The water flow forces the outlet valve open and flow resumes. The line pressure increases gradually, which eliminates water hammer.

The bypass check valve advantageously functions as a pressure relief valve, and eliminates the need to install an external pressure relief device on a high pressure positive displacement pump system. The preferred unloader valve has fewer parts than known unloader valves and is less expensive to build. The unloader valve of the present invention is also more efficient, and delivers more flow in comparison to high pressure pumping systems employing known unloader valves.

In operation, the bypass check valve holds the bypass closed while the system is in the spray mode. The discharge check valve closes when the line is blocked, and the line pressure is trapped between the discharge check valve and the spray gun. When the gun is reactivated, the pressure trapped behind the discharge check valve is relieved, causing the shuttle to move which in turn closes the bypass and directs the full fluid flow to the gun.

DETAILED DESCRIPTION

The present invention is an unloader valve assembly which is particularly useful for incorporation into a high pressure pumping system utilizing a positive displacement pump.

In my copending application for LOW PROFILE POSITIVE DISPLACEMENT PUMP SYSTEM, filed on Jul. 28, 1995 and assigned serial number 08/508,586 which is hereby incorporated by reference, it was shown that an unloader valve can be incorporated into the body of a positive displacement pump and function to control flow and to prevent the buildup of pressure on the outlet side of the pump when the pump discharge line is blocked.

Figure 1:
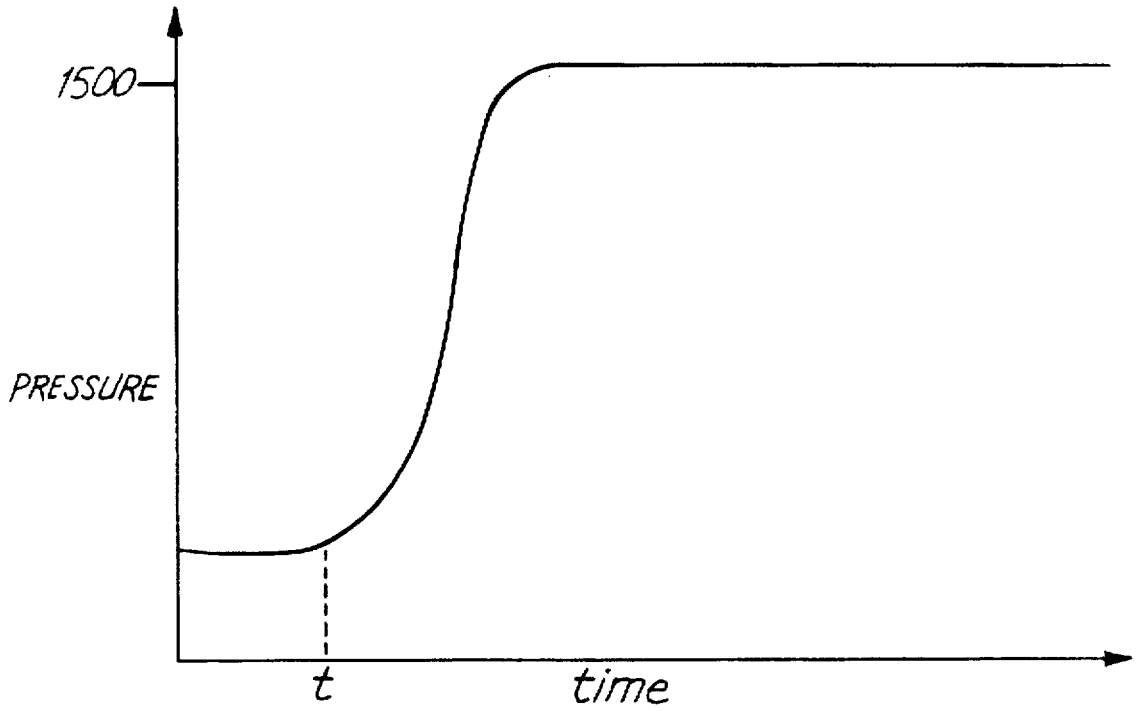
Fig. 1 PRIOR ART
FIG. 1 is a graphical representation of the inlet Pressure to the unloader valve vs. Time of a prior art unloader before and after activation of the gun.
Figure 2:
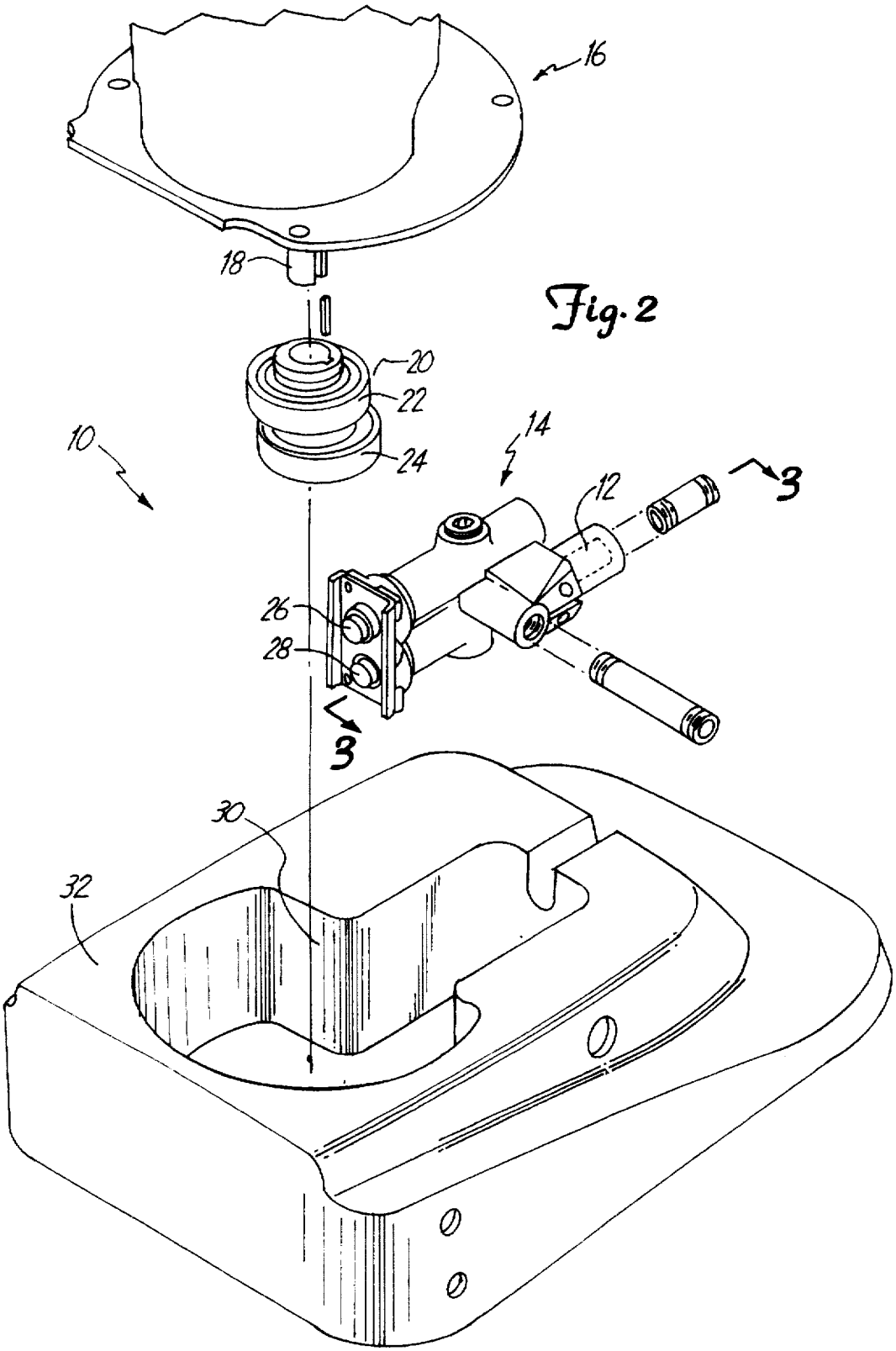
FIG. 2 is an exploded perspective view of a pressure washing system employing the unloader valve assembly of the present invention.

An exploded perspective view of a pumping system 10 employing the unloader valve assembly 12 (shown in phantom) of the present invention is shown in FIG. 2. A positive displacement pump 14 which is preferably a twin piston pump is driven by a gasoline powered engine 16 having a vertical rotational shaft 18. Preferably, a Briggs and Stratton Model Number 10A90 0505-01 (9 cubic inch, 4 horsepower) engine is used. An eccentric pump shaft 20 has upper and lower eccentric surfaces (not shown). Preferably, bearings 22, 24 are mounted onto the eccentric surfaces and contact the driven ends 26, 28 of the piston pump 14.

The pump 14 is mounted into a pump base 30 which supports the pump 14 and the engine 16. Preferably, the engine 16 is mounted to an upper surface 32 of the base 30. The base 30 fixes the orientation of the pump shaft 20 with respect to the driven ends 26, 28 of the shaft.

Figure 3:
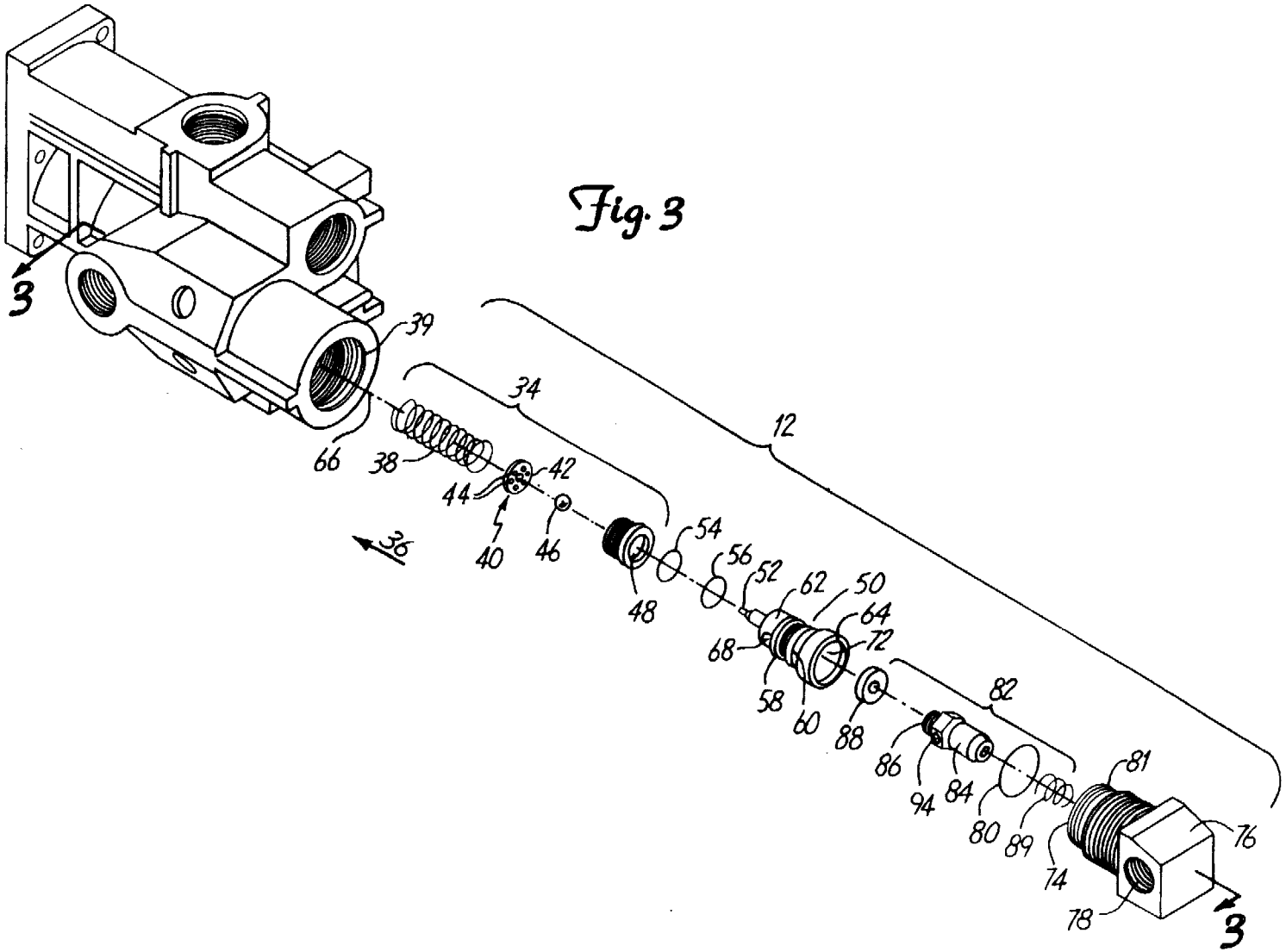
FIG. 3 is an exploded perspective view of the unloader valve of the present invention.

An exploded perspective view of the preferred unloader valve assembly 12 is shown in FIG. 3. A first check valve assembly 34 is provided which prevents liquid from exiting from the bypass when the pump is in the spray mode. The first check valve assembly 34 includes a spring 38 mounted in an aperture 39 of the pump housing. Although the preferred unloader valve assembly 12 is mounted into an aperture 39 in the pump housing, it could also be constructed in its own housing and incorporated into the discharge side of a high pressure pump.

The spring 38 is followed by a retainer 40 which preferably has a central aperture 42 and a plurality of smaller apertures 44 to allow for the passage of fluid. A small ball 46 is provided which rests on one side in the central aperture 42 and on the other side, on a seat 48 when the valve is in the spray mode. The valve seat 48 preferably threads into the aperture 39 and remains stationary during operation.

Preferably, the spring 38 size is selected to provide enough counter pressure to remain closed while the pump is operating at a selected pressure of about 1500 p.s.i. and delivering about 2.5 gallons per minute of liquid. A spring which delivers a 20 pound spring force is most preferable, and provides about 1700 p.s.i. of force. The spring size depends upon the size of the seat. The spring force should be great enough to keep the ball pressed on the seat 48 while the pump is operating at the desired operating pressure.

A shuttle 50 is provided which has a first end 52 which contacts the ball 46 when the shuttle 50 moves in a direction represented by arrow 36. Two O-rings 54 and 56 are mounted into O-ring grooves 58 and 60, respectively. The O-rings 54 and 56 prevent liquid from passing from the outer surface 62 of the shuttle 50 near the first end 52 to the discharge end 64 on the outer surface of the shuttle 50. The O-rings 54 and 56 form a seal between the shuttle 50 and an inner surface of the aperture 39. The seal is loose enough however to allow the shuttle 50 to slide along a central axis 66 of the aperture 39.

The shuttle 50 preferably has a radial bore 68 which is fluidly connected to an axial bore 70 (shown in FIGS. 4 and 5) that is in turn fluidly connected to a tapered bore 72. The tapered bore is preferably frustaconical in shape. When the pump is in the spray mode, the discharge end 64 of the shuttle 50 rests against a shoulder 74 of the outlet fitting 76, which preferably is threaded and includes a ninety degree elbow outlet connection 78. An O-ring 80 is positioned in the groove 81 (shown in FIG. 4) of the outlet fitting 76 and is provided to form a liquid seal between the outlet fitting 76 and the aperture 39. Although a threaded ninety degree elbow 78 is provided as a discharge port, it is to be understood that the size and shape of the discharge port is not important to the function of the valve of the present invention.

A discharge check valve assembly 82 is provided which includes a valve 84 with a first end 86. The first end has a tapered frustaconical surface 87 (shown in FIG. 4) which matches the taper of the bore 72. An O-ring 88 is positioned in groove 89 and is provided to form a seal against the frustaconical surface of tapered bore 72, preventing fluid from passing through the radial and axial bores 68 and 70 of the shuttle 50 when the valve 12 is in the bypass mode. The tapered surface 87 is provided to prevent excess compression of O-ring 88 (also shown in FIGS. 4 and 5).

A spring 89 is provided whose force is overcome by the force of the fluid flow through shuttle 50 when the valve is in the spray mode. Liquid exits tapered bore 72 of the shuttle 50 and presses against the first end 86 of the valve 84, causing the spring 89 to compress. The liquid enters the radial bore 94 of the valve 84 and then passes into the fluidly connected axial bore 96 (shown in FIG. 4). Fluid then exits through the outlet 102.

Figure 4:
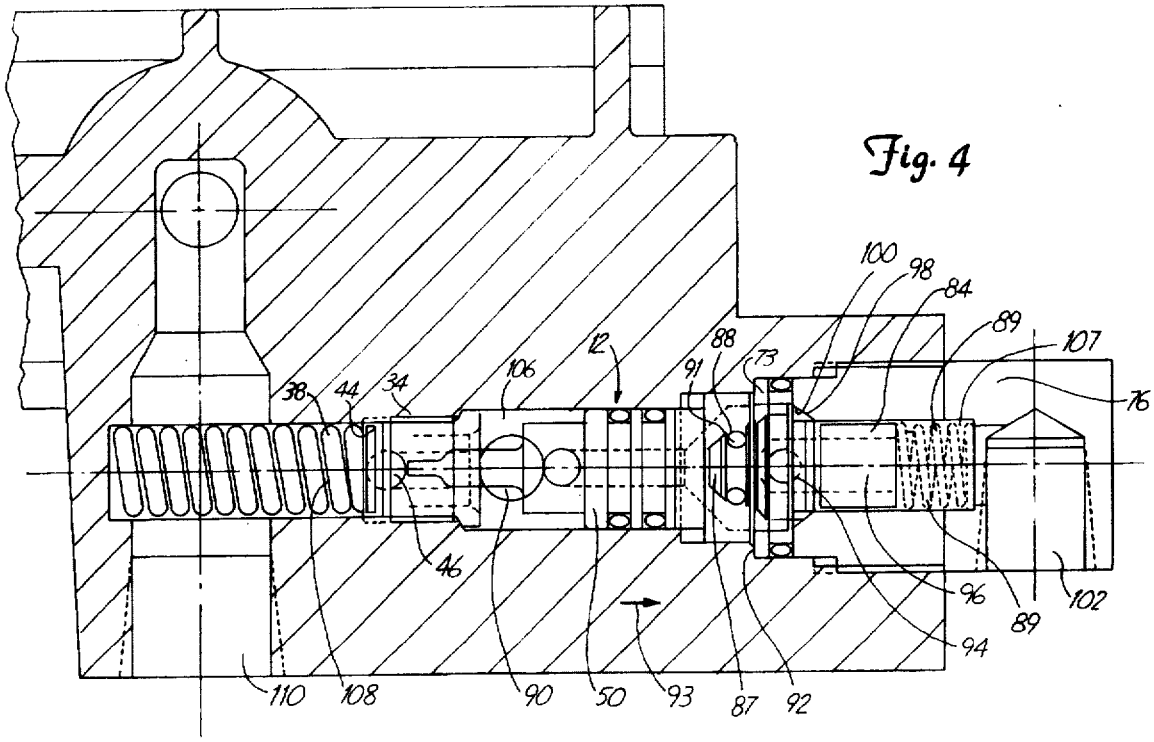
FIG. 4 is a cross-sectional view of the unloader valve of the present invention taken along line 3—3 in FIG. 2 in the spray mode.

The check valve 84 has a stop shoulder 98 which comes into contact with stop 100 and limits the travel of the check valve 84 in the direction represented by arrow 93 (shown in FIG. 4).

Preferably, the entire unloader valve assembly 12 is constructed of stainless steel, with the exception of the outlet fitting 76 which preferably is brass. The springs 38 and 89 are preferably formed of 302 stainless steel. The retainer 44 is preferably made of 303 stainless. The ball 46 is preferably 440 stainless steel, and the seat 44, shuttle 50 and valve 84 are preferably formed of 316 stainless steel. All of the O-rings 54, 56, 58, 80 and 88 are preferably formed of 70 durometer Shore A Buna-N rubber.

The operation of the valve can be best understood by referring now to FIG. 4. FIG. 4 is a cross-sectional view of a pump employing the unloader valve 12 of the present invention, taken along line 3—3 as shown in FIG. 2. FIG. 4 shows the preferred unloader valve 12 in the spray mode. Fluid enters the unloader inlet 90 and causes the shuttle 50 to travel in a direction represented by arrow 93, toward the outlet fitting 76 until the outlet end 73 of the shuttle 50 contacts the shuttle stop 92. Check valve 84 opens, when the force of the fluid on the valve 84 exceeds the opposing force from the spring 89. The open valve 84 allows fluid to pass into radial bore 94, through axial bore 96, and out of the discharge 102. The bypass check valve assembly remains closed because the pressure exerted by spring 38 against the ball 46 exceeds the water pressure in chamber 106. The bypass line remains closed, and no fluid flows back to the pump inlet 110 from the unloader valve.

Figure 5:
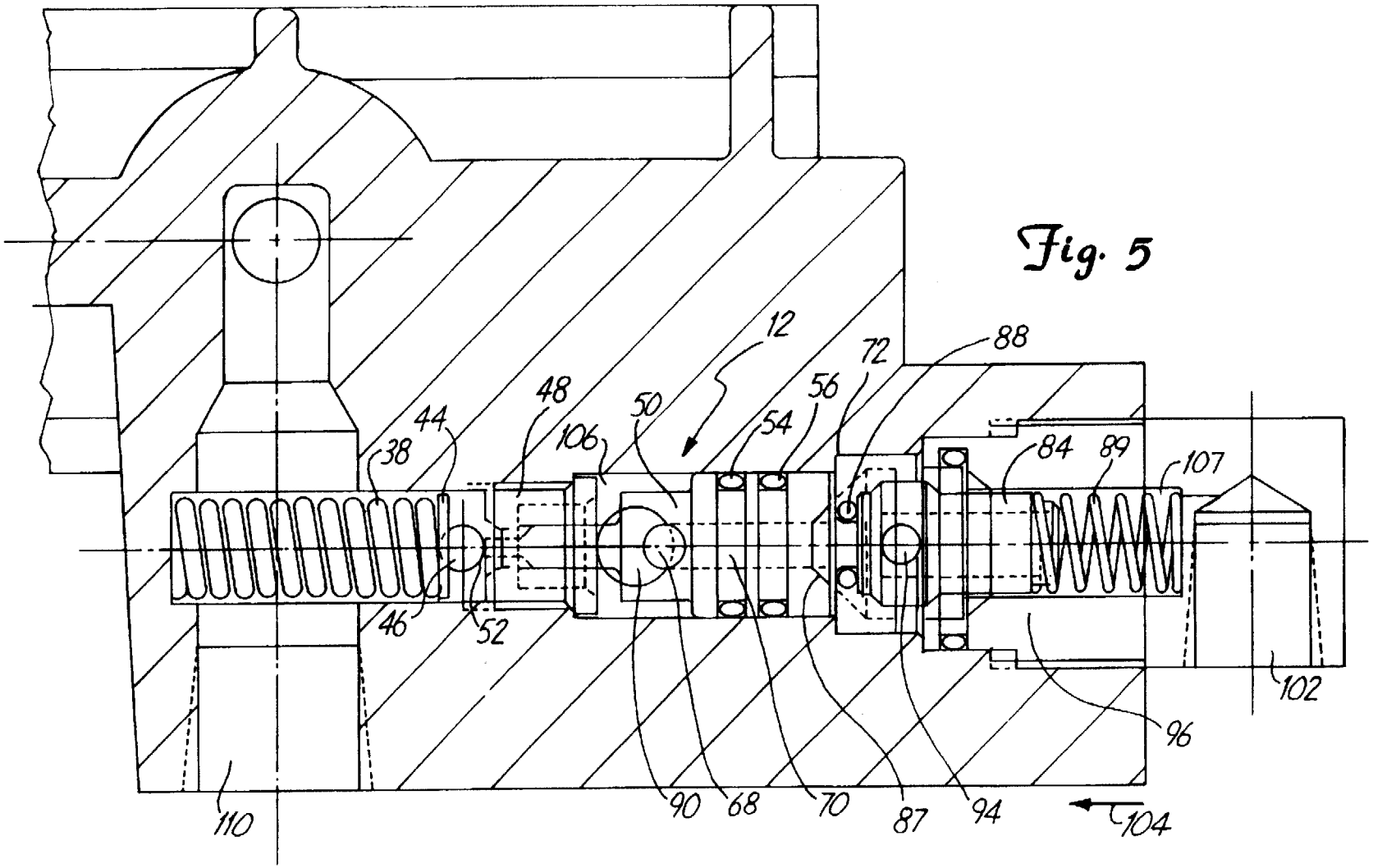
FIG. 5 is a cross-sectional view of the unloader valve of the present invention taken along line 3—3 in FIG. 2 in the bypass mode.

The operation of the valve in the bypass mode can be best understood by referring now to FIG. 5. FIG. 5 is a cross-sectional view of the preferred unloader valve taken along line 3—3 (shown in FIG. 2). When the outlet line is blocked off, for example when the gun is turned off, the check valve 84 closes from the force exerted by spring 89, forcing the O-ring 88 to press against the tapered bore 72. The tapered end 87 of the valve 84 prevents excess compression of the 0-ring 88.

The outlet line in the spray mode typically discharges water at a rate of approximately 2.5 gallons per minute at about 1500 p.s.i. Once the check valve 84 closes, the line pressure rises to a pressure which is approximately equal to the pressure exerted by the spring 38. The line pressure increase occurs because the response time in valve 84 is not instantaneous. Since the system employs a positive displacement pump, the line pressure would continue to rise if it were not for the presence of the check valve assembly 34.

The 1700 p.s.i. line pressure is just high enough to overcome the force of spring 38, permitting the shuttle 50 to move in a direction represented by arrow 104. The first end 52 of the shuttle drives the ball 46 off of the seat, dropping the pressure in the space 106 between the first end 52 of the shuttle and the O-ring seals 54 and 56. The trapped pressure behind valve 84 in space 107 causes the shuttle 50 to move further in a direction represented by arrow 104. The combination of the rising pressure behind valve 84, as well as the pressure drop in space 106 permits a fairly rapid shift from the spray mode to the bypass mode. In contrast, when moving from the bypass to the spray mode, the pressure in an area defined as space 106 is fairly low. When the gun is activated, the force of the pressure in space 107 drops, and spring 38 slowly drives the shuttle in the direction of arrow 93 causing a gradual build up of pressure. Since the spring is very weak compared to springs known in the art, the line pressure increases gradually. The preferred spring delivers 20 pounds of force, while known springs deliver close to 900 pounds, for example.

Figure 6:
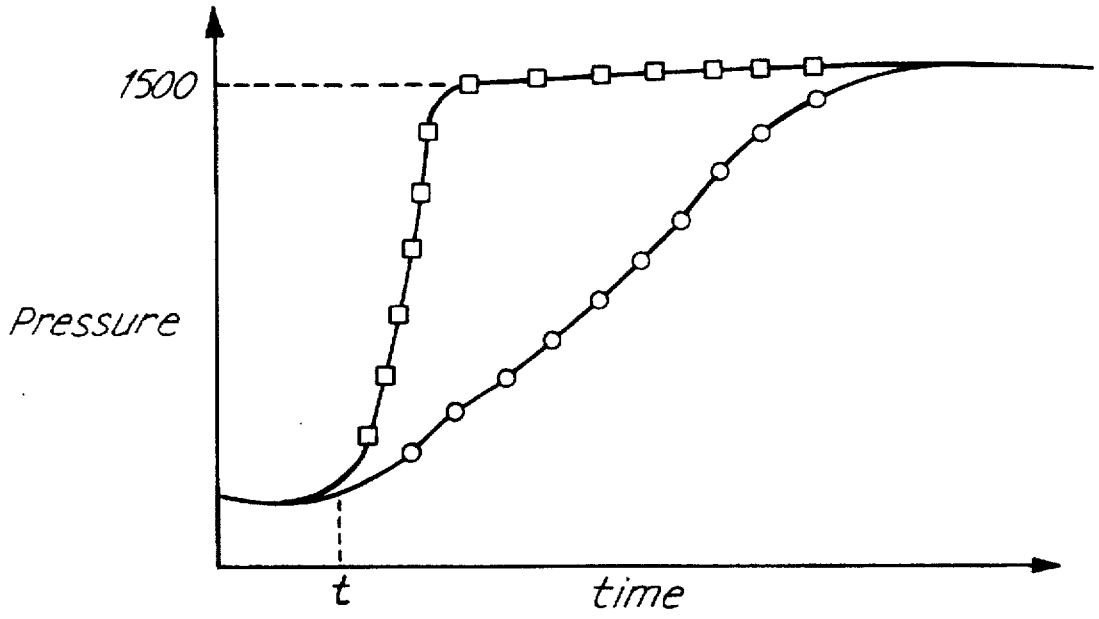
FIG. 6 is a graph of Pressure vs. Time at the inlet of the unloader valve of the prior art and of the present invention when the gun is activated at point "t".

Referring to FIG. 6, the pressure rise in the line at the water inlet 90 to the unloader valve 12 for a prior art unloader valve is shown by the line including square boxes. In contrast, the pressure rise when the gun is activated at time "t" with the unloader valve of the present invention is more gradual, and prevents water hammer and jerky movements of the gun and system.

Figure 7:
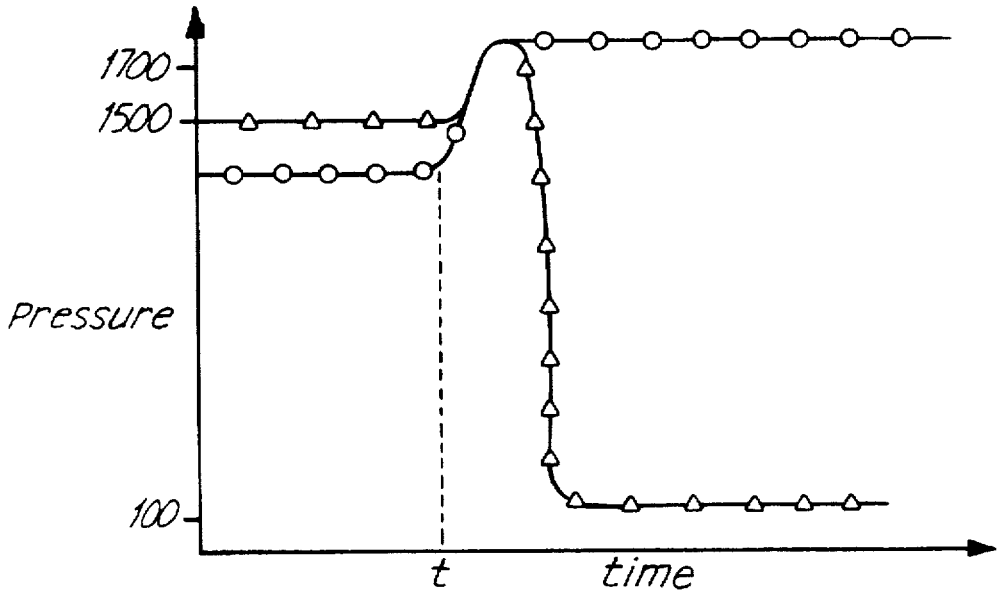
FIG. 7 is a graphical representation of Pressure vs. Time at the inlet (shown as triangles) and at the outlet (shown as circles) of the unloader valve of the present invention.

Referring now to FIG. 7, the line represented by triangles shows the pressure at the entrance to the unloader valve 12 over time in response to closing the valve on the gun. As can be seen, the pressure momentarily rises (to about 1700 p.s.i.) until the check valve assembly 34 releases some of the pressure. The shuttle moves further in the direction shown by arrow 104, and the resulting inlet pressure falls to approximately 100 psi. The outlet pressure is represented by the line containing circles, as shown in FIG. 7. At time "t", when the valve on the gun is closed, the outlet pressure abruptly rises to about 1700 p.s.i., which is the pressure which equals the force exerted by spring 38. The pressure remains at 1700 p.s.i. until the valve on the gun is opened.

Referring back to FIG. 4, the unloader valve is typically positioned such that the outlet of the bypass 108 is fluidly connected to the fluid inlet 110 to the pump. When the unloader valve 12 is in bypass, the fluid exiting the pump outlet returns to the pump inlet.

The total pressure drop across the unloader valve of the present invention while the system is in the spray mode is approximately 100 p.s.i., when the flow is approximately 2.5 gallons per minute.

The device of the present invention advantageously does not require flow through the bypass loop while a pumping system employing the unloader valve of the present invention is in the spray mode. The device includes a built-in pressure relief valve (assembly 34) which eliminates the need to build an external pressure relief device into the spraying system. There are fewer parts than with known unloader valves, and the manufacturing cost is therefore lower. The pressure rise in the system after the gun is activated is much more gradual than the rate of pressure rise with known unloader valve systems, and therefore water hammer is eliminated, and the pumping system life and reliability is increased.

Although the present invention has been described with reference to the preferred embodiments, workers skilled in the art will recognize that changes may be made in form and detail without departing from the spirit and scope of the invention.

What is claimed is:

1. A full flow, pressure trap unloader valve, comprising:

a valve body having a central cavity, a water inlet, outlet and bypass each fluidly connected to the central cavity;

a bypass check valve positioned at the bypass and fluidly connected to the cavity, having a fluid passage which permits fluid to pass from the water inlet to the bypass when the valve is in an open position;

a shuttle positioned for sliding movement within the cavity, the shuttle having an actuator end for opening the bypass check valve, an opposite end, an outer surface, a liquid seal between the outer surface and the opposite end which contacts an inner surface of the cavity, and a fluid passage between the outer surface and second end; and an outlet check valve positioned in the outlet and fluidly connected to the cavity, having a first end adapted for blocking the passage of fluid exiting from the fluid passage of the shuttle, an outside surface, an opposite end and a fluid passage between the outside surface and the second end.

2. The device of claim 1 wherein the central cavity is substantially cylindrical.

3. The device of claim 1 wherein the bypass check valve comprises a spring which is strong enough to hold the valve closed against an operating pressure.

4. The device of claim 3 and further comprising a ball and seat, wherein the spring delivers 20 pounds of force to the ball and seat.

5. The device of claim 1 wherein the fluid passage of the shuttle has a radial and axial component.

6. The device of claim 1 wherein the fluid passage has a frustaconical outlet.

7. The device of claim 6 wherein the first end of the outlet check valve has a tapered surface which matches the taper of the fluid passage.

8. The device of claim 1 wherein the outlet check valve comprises a spring which provides force sufficient to close the valve in the absence of fluid flow, but is insufficient to close the valve during fluid flow.

9. The device of claim 1 wherein the fluid passage of the outlet check valve has a radial and an axial portion fluidly connected to the radial portion.

10. A full flow unloader valve comprising:

a valve body with a fluid inlet, fluid outlet, fluid bypass and a central cavity fluidly connected to the fluid inlet, fluid outlet and fluid bypass;

a bypass check valve fluidly connecting the fluid inlet and bypass when the valve is in an open position, comprising a valve seat;

a reciprocating shuttle positioned in the bore, having a first end adapted for actuating the bypass check valve, an outer surface, an opposite end, a liquid seal positioned between the outer surface and the second end; and a fluid passage between the outer surface and the second end, wherein the seal prevents passage of liquid around an outside surface of the shuttle, wherein the fluid inlet is positioned between the shuttle seal and the valve seat; and a discharge check valve fluidly connected to the pump outlet, having an outer surface, a first end shaped to block fluid flowing from the second end of the shuttle; a second opposite end and a fluid passage from the outer surface to the second end, wherein the fluid passage is fluidly connected to the outlet.

* * * * *